US007958684B2

(12) United States Patent
Kleege

(10) Patent No.: US 7,958,684 B2
(45) Date of Patent: Jun. 14, 2011

(54) TRACK SUSPENSION DEVICE

(75) Inventor: Nevin Kleege, Vista, CA (US)

(73) Assignee: Airwall Hangers, Inc., Vista, CA (US)

( * ) Notice: Subject to any disclaimer, the term of this patent is extended or adjusted under 35 U.S.C. 154(b) by 930 days.

(21) Appl. No.: 11/577,917

(22) PCT Filed: Oct. 25, 2005

(86) PCT No.: PCT/US2005/038647

§ 371 (c)(1),
(2), (4) Date: Apr. 25, 2007

(87) PCT Pub. No.: WO2006/047626

PCT Pub. Date: May 4, 2006

(65) Prior Publication Data

US 2009/0127412 A1 May 21, 2009

(51) Int. Cl.
*E04H 1/00* (2006.01)

(52) U.S. Cl. ..... 52/243.1; 52/241; 52/506.08

(58) Field of Classification Search ..... 52/238.1, 52/243.1, 241, 506.06, 506.08
See application file for complete search history.

(56) References Cited

U.S. PATENT DOCUMENTS

| | | | | | |
|---|---|---|---|---|---|
| 1,716,625 | A * | 6/1929 | Dawson | ..... | 52/243.1 |
| 2,881,876 | A * | 4/1959 | Williams | ..... | 52/126.4 |
| 3,386,216 | A * | 6/1968 | Zwickert | ..... | 52/205 |
| 4,103,463 | A * | 8/1978 | Dixon | ..... | 52/126.4 |
| 6,079,174 | A * | 6/2000 | Williams et al. | ..... | 52/243.1 |

* cited by examiner

*Primary Examiner* — Basil Katcheves
(74) *Attorney, Agent, or Firm* — Charmasson, Buchaca & Leach, LLP

(57) ABSTRACT

A device for suspending equipment such as a lighting fixture or public address speaker from a ceiling mounted track (5) used to suspend a movable partition and including an extruded rail (4) defining a channel having a longitudinal slot opening (8) between flanges (9) projecting inwardly from opposite lateral walls(6) of the rail. The device comprises a threaded stem (13) capped by an enlarged head (14) passes through the slot opening (8) and is engaged by a lug (17) which cooperates with the head to forcibly bear against or capture one or more of the flanges. In an alternate embodiment of the invention the axial movement of the lug along the stem and the rotational movement of the head in reference to the slot are accurately limited for ease of alignment. The device can be quickly loosened to allow horizontal adjustment of the suspended structure along the rail.

19 Claims, 6 Drawing Sheets

TRACK SUSPENSION DEVICE

FIELD OF THE INVENTION

This invention relates to track fasteners and more specifically to tracks and slidable attachment brackets used to suspend equipment and structures from ceilings, walls and other similar structural surfaces.

BACKGROUND

Arranging a site for a spectacle, meeting or other gathering requires the temporary installation of a large amount of equipment and other structures that must be suspended from ceilings, beams or other overhead elements or attached to walls in a very secure, but also quickly adjustable manner.

For example, lighting apparatuses for a stage, audio and video equipment, cabling, props and curtain walls for subdividing a large meeting hall are often suspended from rails of tracks affixed to an overhead structure. Bolts passing through holes in the rail or track and appropriate brackets are commonly used, but do not allow quick and easy transversal adjustment of the position of the suspended items along the track. Adjustable track attachments of the prior art have been mainly intended for attaching relatively light components such as light fixtures and speakers, and can damage track surfaces, and nearby ceilings and ceiling trim.

The ceilings of meeting rooms in convention halls and hotels are often crisscrossed by tracks or rails from which movable room dividers or curtain partitions are suspended. Typically, such a track comprises a backplate affixed to the ceiling and two side-walls projecting downwardly from the backplate and terminated by flanges extending inwardly toward each other and separated by a gap or passageway through which suspension hardware is engaged into the internal channel defined by the track. It would be advantageous to meeting planners and event organizer to use the aforesaid tracks or rails for attaching temporary lighting or sound equipment.

The instant invention results from a search for a sturdy type of adjustable track attachment that can be quickly and easily translated along a track while supporting heavy equipment, and avoiding damage to the track and surrounding structures, and to take advantage of existing mobile partition and room divider ceiling tracks to install temporary equipment.

SUMMARY

The instant embodiments provide a simple and sturdy attachment device for suspending heavy structures from a ceiling or other undersurface and allowing quick and easy adjustment of the position of the suspension device along an overhead track or rail including those already mounted in the ceiling of a meeting room for holding movable partitions.

Some embodiments provide that by affixing to the overhead structure, a rail defining a channel into which projects two or more flanges or ribs. The suspension member comprises a threaded stem passing between the flanges and being capped by a head. A slug screwably translatable along the stem can be manipulated to create forceful contact between the flanges, or the top portion of the rail or all of these elements in order to securely immobilize the stem by simple rotation of the stem itself or a fastener engaged over it. By providing forceful contact on the internal surfaces of the rail elements, damage to the outside surfaces and surrounding structures is avoided.

In some embodiments of the invention, the slug and head are oblong and dimensioned to pass through a bottom slot in the rail between the flanges in one orientation, then come into contact with the flanges when rotated 90 degree once inside the rail channel.

In an alternate embodiment of the suspension member, the rotational movement of the head is accurately limited by squared ribs in the upper part of the stem.

Some embodiments provide a device, for releasably suspending a structure at a horizontally adjustable position which comprises: a rail including: a pair of substantially vertical and parallel sidewalls defining a channel therebetween; a pair of flanges, each projecting inwardly toward the other flange and defining a longitudinal slot therebetween; at least one bracket shaped and positioned for attachment of said rail to a wall or ceiling; a slidable bracket engaged into said channel and including: a threaded stem of a given diameter; a head-capping one end of said stem; and, a member engaged over, and screwably translatable along said stem; whereby said member can be forcedly locked against at least one of said flanges to immobilize said stem. In some embodiments said member comprises a lug having a central, axial bore engaged over said stem. In some embodiments said slot has a given width greater than said diameter; said bracket comprises an horizontal backplate orthogonally secured to upper edges of said sidewalls; and, said lug has an oblong transversal profile of a length greater and a horizontal thickness smaller than said given width; whereby said lug can be longitudinally oriented to pass through said slot, then rotated to come in partial contact with at least one of said flanges and prevent said bracket from escaping said channel. In some embodiments said bore is threaded for engagement with said stem; whereby rotation of said stem brings said head against said backplate and said member against said flange. In some embodiments said flanges project toward one another in a common plane from distal end portions of said side walls. In some embodiments said flanges lie in different planes separated by a given axial distance, and said lug has opposite bearing undersurfaces lying in different planes separated by said given distance. In some embodiments said bore is dimensioned to allow non -rotational, axial translation of said lug along said stem; and said member further includes an adjustment nut dimensioned to screwably engage over said stem and move said lug toward said head; whereby one of said flanges can be forceably pinched between said head and said lug by rotation of said nut. In some embodiments said member further comprises a sleeve slidingly engaged over said stem between said lug and said nut. In some embodiments said flanges lie in different planes separated by a given distance; and said head comprises an extension projecting parallelly to and distally from said stem to a length substantially equal to said distance; whereby when a flange closest to said backplate is captured between the head and the lug, said extension bears against the other flange. In some embodiments said head is swivelly secured to said one end ofthe stem. In some embodiments said lug further comprises a resiliently compressible layer lining bearing surfaces contacting said flanges. In some embodiments said stem has a radial bore in a distal section thereof. In some embodiments said flanges run continuously within said channel. In some embodiments said flanges project from upper edges of said sidewalls. In some embodiments said head has on oblong transversal profile; said stem is fixedly secured to said head; said lug has a cut-out portion spanning said horizontal thickness, and being shaped and dimensioned to partially and intimately nest said head when said head is oriented perpendicularly to said lug. In some embodiments said stem has a squared upper section proximate said head, said section being shaped and dimensioned to prevent rotation of said head in reference to said lug when said head is not nested into said cut-out portion. In some embodiments said lug has a width larger than the width of said slot, and further comprises a longitudinal projection extending upwardly, said projection having a width smaller than the width of said slot. In some embodiments said member further comprises a lock nut screwably engaged over said stem below said adjustment nut. In some embodiments said squared section comprises first and second ribs, each of said ribs having convergent orthogonal sides tangential to said stem. In some embodiments one of said ribs extends from said head along said stem to a lesser length than the length of the other of said ribs. In some embodiments said ribs are diametrically opposed to each other.

Other embodiments provide a device for releasably suspending a structure from an undersurface which comprises: an extruded, tubular rail having a substantially quadrangular cross-section defining a top wall, a bottom wall, and opposite first and second lateral walls, a slot running axially in a median section of said bottom wall, said slot having a given width, and a rib projecting internally and inwardly from one of said lateral walls at a given distance from said bottom wall; a bracket including: a threaded stem of a given diameter; a head secured to a top end of said stem; an oblong lug having a bore in a median section, engaged by said stem; said lug having a width lesser than said given width and a length greater than said given width; and means for adjustably translating said lug along said stem. In some embodiments said means for translating comprises said bore being threaded to mate with said stem. In some embodiments said means for translating comprises a nut engaged over said stem from a bottom end thereof. In some embodiments said lug has a downward projection extending said given distance from a bottom surface section of said lug. In some embodiments said head has a downward projection extending said given distance from a bottom surface section of said head. In some embodiments said head is shaped and dimensioned to rest said projection on said bottom when said head rests against said rib.

In some embodiments there is provided that in a movable room divider installation, wherein partitions are suspended from a ceiling-mounted track having a backplate affixed to the ceiling, two vertical side-walls spaced apart by a given distance and at least two flanges projecting horizontally and inwardly from said side-walls and defining therebetween apassageway for suspension hardware, an improvement for attaching equipment to said track comprising: a threaded stem; a lug having a width commensurate with said passageway, a length no greater than said distance and a central bore engaged by said stem; and means for forcingly locking said lug against said flanges. In some embodiments said means for locking comprise: a head shaped and dimensioned to pass trough said passageway and capping said stem; and said bore having internal threads mating with said stem. In some embodiments said means for locking comprise: a head capping said stem and having a width slightly lesser than said passageway and a length slightly lesser than said distance; and a nut engaged over said stem and positioned under said lug. In some embodiments each of two of said flanges project from said side-walls at different distances from said backplate; and said lug has longitudinal ends of different thicknesses.

DESCRIPTION OF THE INSTANT EMBODIMENTS

Figure 1:
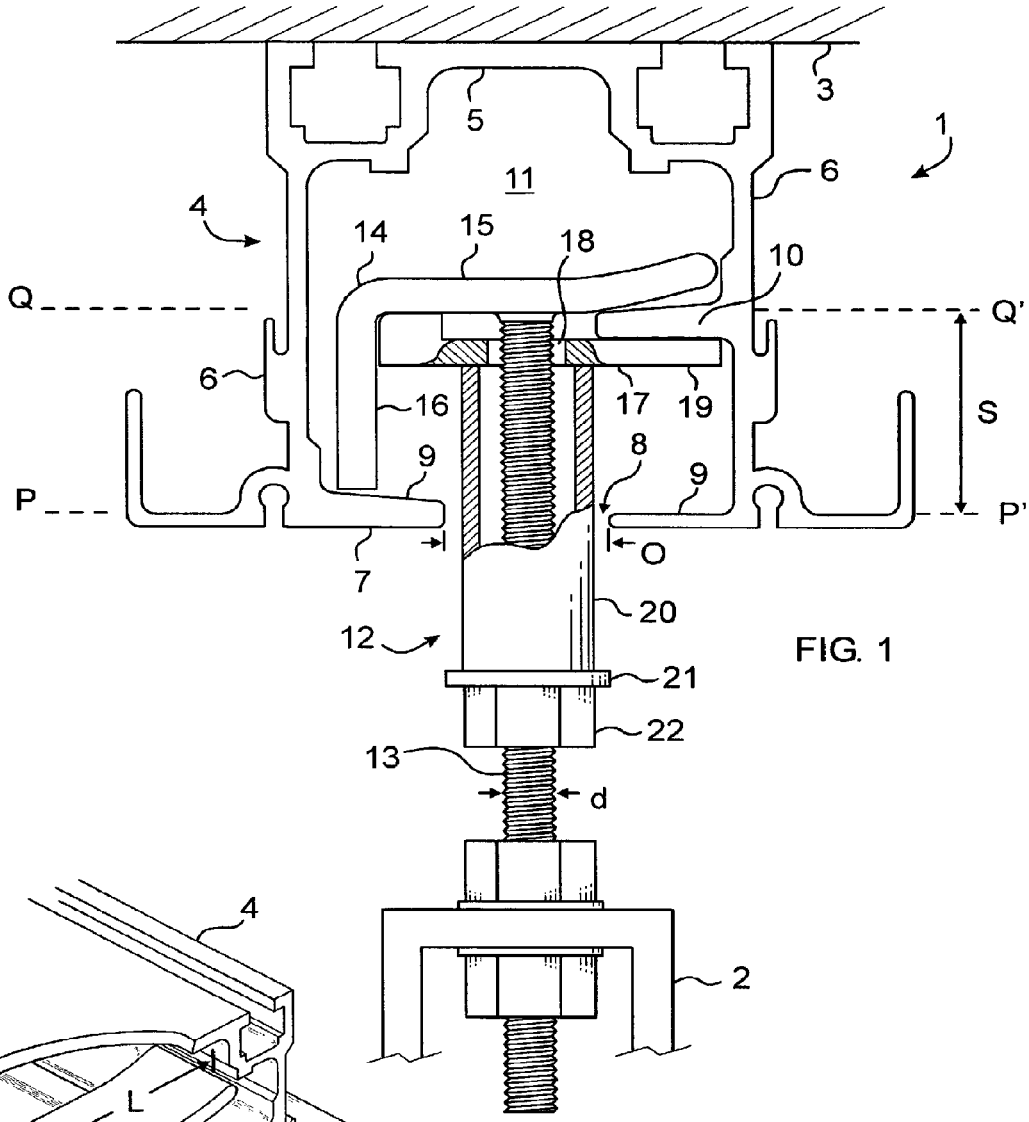
FIG. 1 is a front view of a track suspension device according to the invention.
Figure 2:
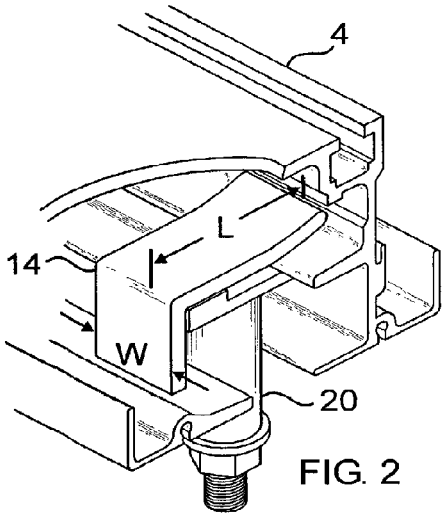
FIG. 2 is a partial perspective view thereof.

Referring now to the drawing, there is shown in FIGS. 1 and 2 a device 1 for suspending a partition 2 or other structures from a ceiling 3 or other undersurface. The device comprises an extruded, tubular rail 4 having a substantially quadrangular cross-section defining a top wall or backplate 5 which is fixedly secured to the ceiling 3, a pair of opposite, substantially vertical and parallel lateral walls or side-walls 6 projecting downwardly from the top wall 5 and a bottom wall 7 defining a channel therebetween. A slot 8 runs axially along the full length of the bottom wall 7 and defines an opening having a given width O. The remaining portions of the bottom wall astride the slot define a pair of flanges 9 projecting in a common plane P-P' inwardly toward each other from the distal or bottom edges of the lateral walls 6. An additional flange or rib 10 projects inwardly from a median section of one of the lateral walls 6 and along a second plane Q-Q' parallel to, and separated from the first plane P-P' by a given distance S. The rail 4 defines an internal channel 11 which is engaged by a suspension member 12 passing through the slot 8.

The suspension member 12 comprises a threaded stem 13 of a given diameter d. The upper end of the stem is capped by a head 14. The head comprises a horizontal, oblong section 15 orthogonally and fixedly secured about a median section to the top end of the stem, and a projection 16 extending downwardly and orthogonally from one end of the oblong section 15 parallely to, and distally from the stem 13. The length of the projection 16 is substantially equal to the distance S between the aforesaid planes. The width W of the head is no greater, and preferably slightly lesser than the width O of the slot 8. The length of the oblong section 15 is substantially greater than the width O of the slot 8. The rib 10 does not project into the channel any further than the bottom flange 9 lying below it. Accordingly, the head can be longitudinally oriented in the same general direction of the slot 8 and engaged into the passageway defined by the flanges and rib in the median portion of the channel, then rotated 90 degrees to bring one end of the oblong section 15 over the rib 10 and the bottom tip of the projection 16 above one of the flanges 9. An oblong lug 17 having an external profile substantially symmetrical with the oblong section 15 of the head is engaged over the stem 13 through a non-threaded cental, axial bore 18 whose diameter is slightly larger than the diameter d of the stem. The lug can thus be easily longitudinally oriented and inserted through the slot 8 then transversally oriented in the same manner and position as the head so that a marginal portion is brought immediately under the rib 10. A tubular sleeve 20 preferably fixedly secured to the undersurface of the lug 17 coaxially with the bore 18 extends downwardly through the slot 18, and is supported by a washer 21 and nut 22 engaged over the stem from the bottom end thereof. The lug 17 and sleeve 20 can be screwably translated along the stem 13, and tightened to press against the undersurface of the rib 10 by turning the nut 22, causing at the same time the head to come in forceful contact against the upper surface of the rib 10. The pinching of the rib between the head and lug, and the forced resting of the extension 16 against one of the flanges 9 immobilize and stabilize the position of the suspension member 12 within the rail by forcingly locking the lug 17 against one of the flanges and the rib 10.

Figure 3:
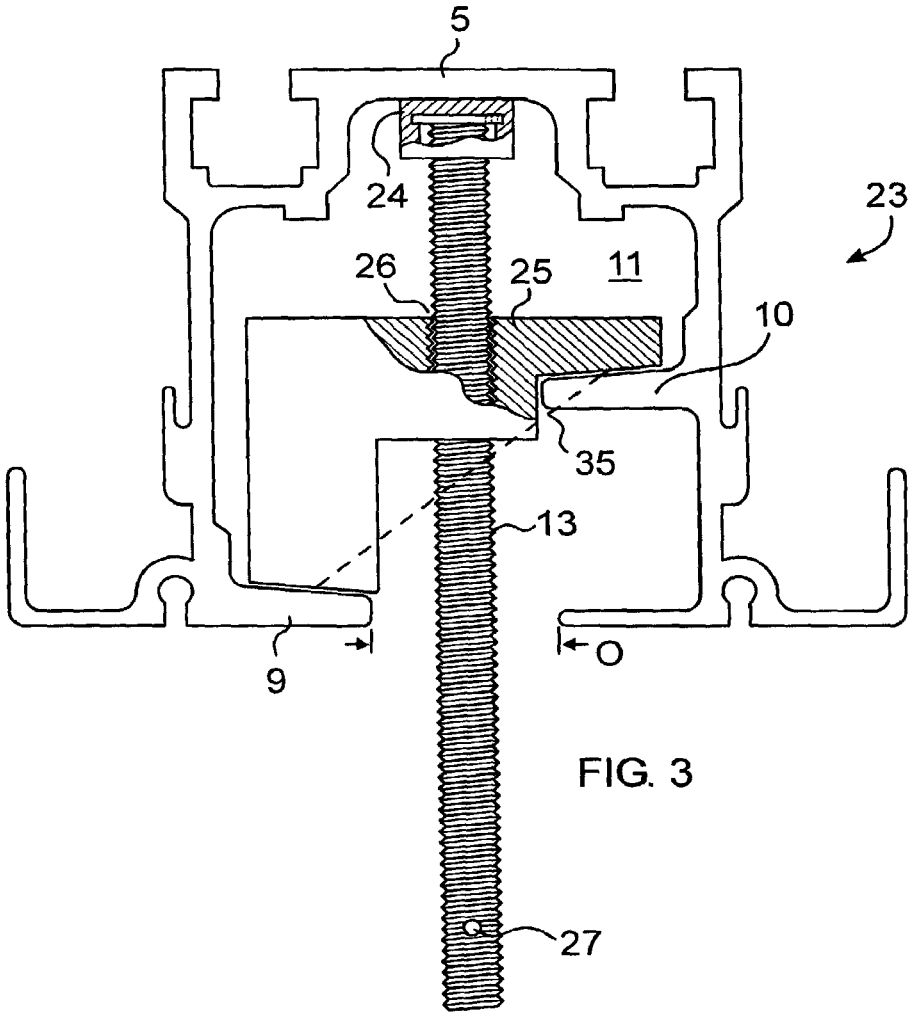
FIG. 3 is a front view of a first alternate embodiment of the invention.
Figure 4:
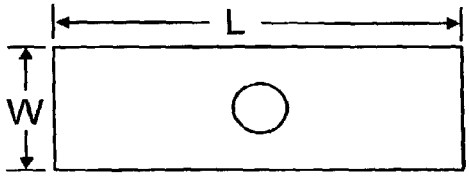
FIG. 4 is a top plan view of the slug.

In a first alternate embodiment of the invention 23 illustrated in FIGS. 3 and 4, the head 24 capping the stem 13 is circular and swivelly attached to it. A lug 25 substantially similar in shape and dimension to the lug 17 used in the first embodiment, has a threaded central bore 26 which is mated to the stem. Again, the overall length L of the lug is substantially greater than the width O of the bottom slot, and its width W is slightly lesser. In other words, the width of the lug is commensurate with the passageway defined between the flanges and rib, and its length is no greater than the width of the internal channel 11 defined by the rail. A diametrical bore 27 in a bottom section of the threaded stem 13 is dimensioned to accept the tip of a screwdriver or other similar tool that can be used to rotate the stem in order to forcefully bring the top of the head 24 against the backplate or top wall 5 of the rail while the lug 25 is forced downwardly against the rib 10 and the opposite flange 9.

Figure 5:
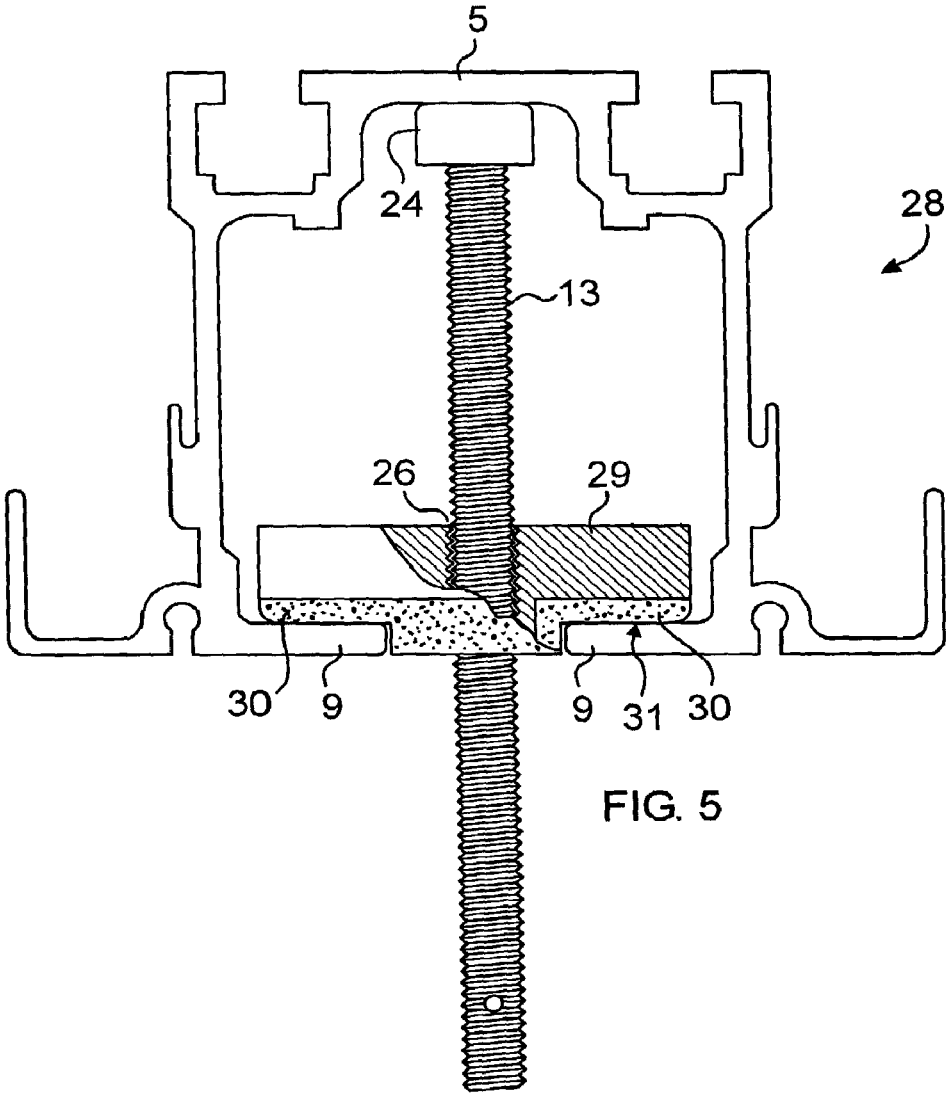
FIG. 5 is a front view of a second alternate embodiment of the invention.

In a second alternate embodiment 28 of the invention illustrated in FIG. 5, the head 24 capping the threaded stem 13 is similar to the one illustrated in FIG. 3. The lug 29 has a similar central bore 26, but does not have a downward projection. Accordingly, both longitudinal ends 30 of the lug can be brought into contact with the upper surfaces of the flanges 9. The central rib 10 of the previously described embodiments is not used and no longer necessary. The bottom surface 31 of the lug is lined with a resiliently compressible material such as neoprene or nylon in order to increase friction with the flanges.

Figure 6:
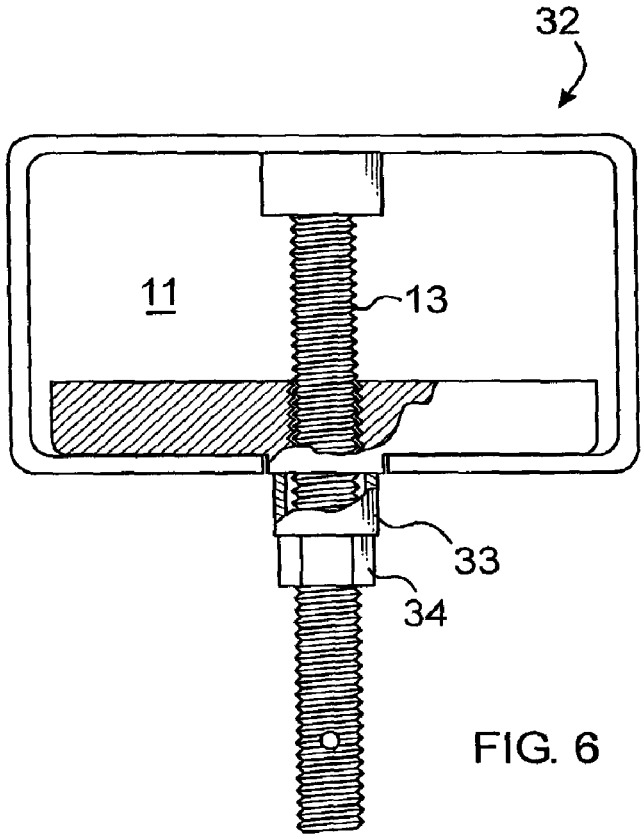
FIG. 6 is a front view of third alternate embodiment of the invention.

The third alternate embodiment 32 of the invention illustrated in FIG. 6, is essentially similar to the second alternate embodiment 28 of FIG. 5, with the addition of a sleeve 33 and nut fastener 34 engaged over the stem under the lug. After the suspension bracket has been secured and immobilized within the rail channel 11 tightening of the nut 34 on the stem 13 provides a positive locking of the suspension mechanism.

Figure 7:
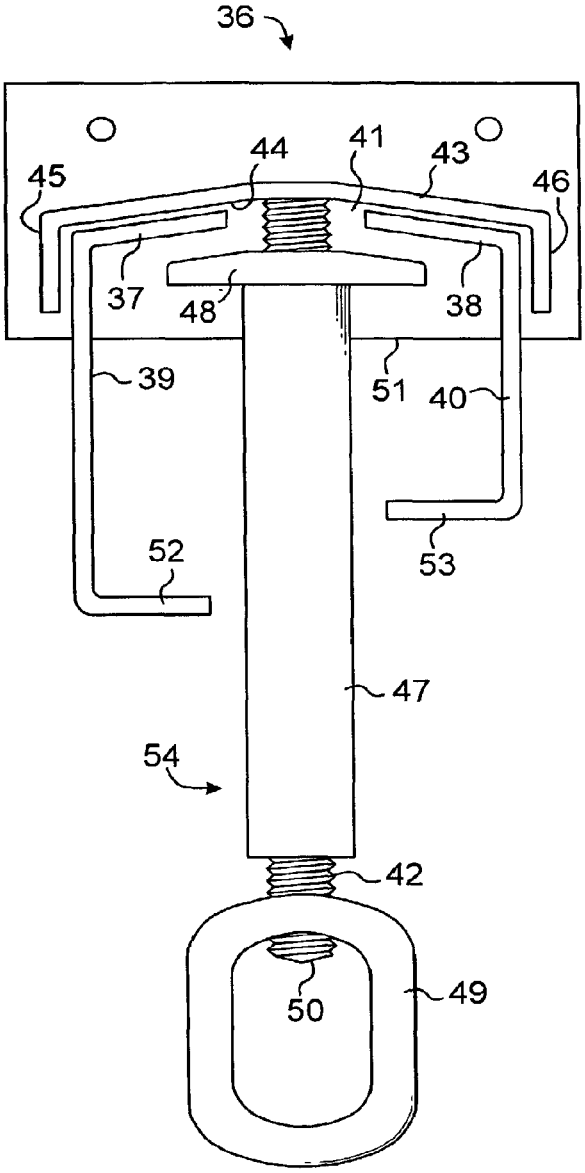
FIG. 7 is a front view of a fourth alternate embodiment of the invention.
Figure 8:
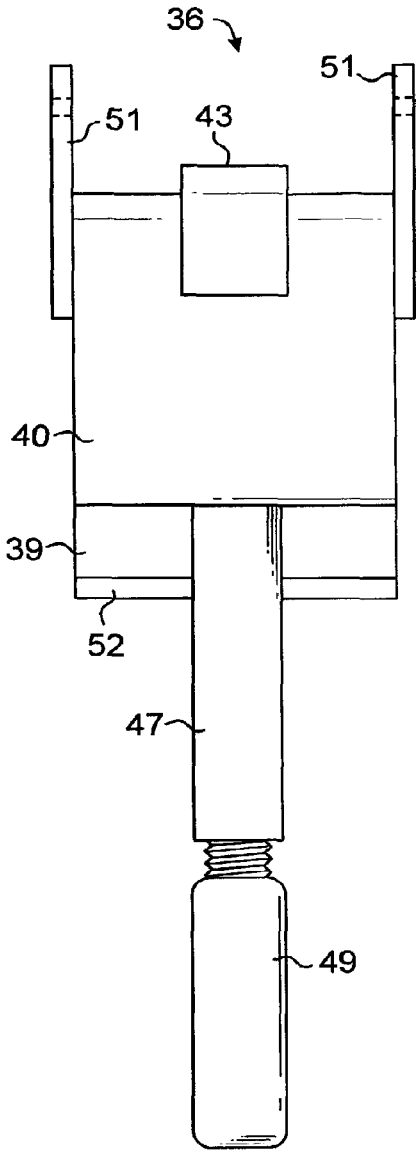
FIG. 8 is a side view thereof.
Figure 9:
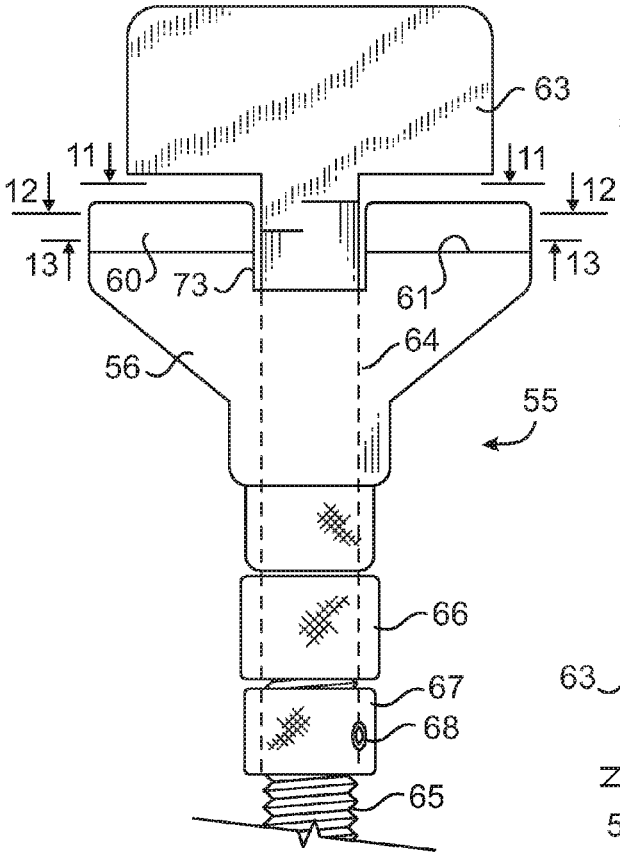
FIG. 9 is a front view of a fifth alternate embodiment of the suspension member.

In the fourth alternate embodiment 36 ofthe invention illustrated in FIGS. 7 and 8, flanges 37 and 38 project inwardly from the upper edges of sidewalls 39 and 40 respectively. The logitudinal slot 41 between the flanges is engaged by the threaded stem 42 that is capped by the head 43. The head is fixedly attached to the top of the stem and has a lower profile 44 that closely matches the top ofthe flanges, and short external portions 45,46 extending over the sidewalls 39,40. A tubular sleeve 47 is fixedly secured at an upper portion to an oblong lug 48 having a longitudinal dimension larger than the width of the slot 41 is slidingly engaged over the stem 42. A ring nut 49 screwed over the lower end 50 of the stem is used to lock the lug 48 against the lips of the flanges A number of vertical brackets 51 secured to the sidewalls and flanges are used to attach the device to walls or to a ceiling. The lower flanges 52,53 limit the lateral movement of the suspension member 54.

Figure 10:
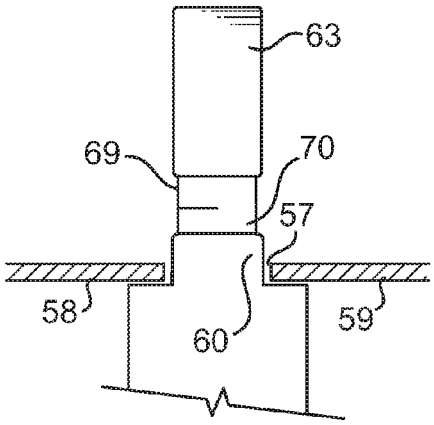
FIG. 10 is a side view thereof with the head in the unlocked position.

As shown in FIGS. 9-14, a fifth alternate embodiment 55 of the suspension member can be used in connection with any one of the rails shown in FIGS. 1-8. In this embodiment, the lug 56 has a width and thickness larger than the slot 51 between the flanges 58,59, and is not designed to be oriented transversally to the slot, but rather in line with it. A projection 60 extending upwardly from the top of the lug is shaped and dimensioned to have a width slightly smaller than that of the slot 57 so that it can engage into the slot until the shoulders 61,62 astride the projection come into contact with the lower surfaces of the flanges. The head 63 having an oblong transversal profile and limited thickness so that it can pass through the slot in an unlocked orientation as shown in FIG. 10. The head can rotate over a 90 degree arc to a transversal position perpendicular to the slot 57. The bore 64 in the center of the lug 56 is not threaded and allows for a sliding translation of the lug over the stem 65. An adjustable nut 66 with a knurled outer surface is used to bring the head toward the lug. A lock nut 67 screwed on the stem below the adjustable nut limits the play of the lug. The lock nut is immobilized by the tightening of a lateral screw 68. The angular location of the screw can act as an indicia of the angular orientation of the head, either in the unlocked, insertion orientation or the locked orientation when direct viewing of the head is obscured by the flanges.

Figure 11:
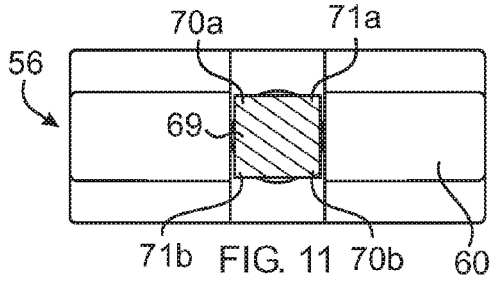
FIG. 11 is a cross-sectional view taken along line 11-11 of FIG. 1.
Figure 12:
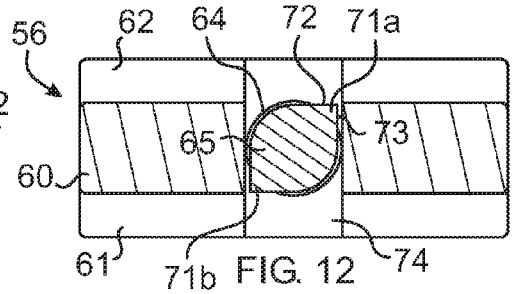
FIG. 12 is a cross-sectional view taken along line 12-12 of FIG. 1.
Figure 13:
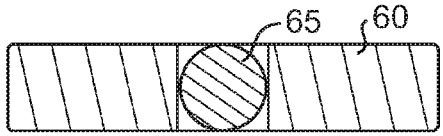
FIG. 13 is a cross-sectional view taken along line 13-13 of FIG. 1.
Figure 14:
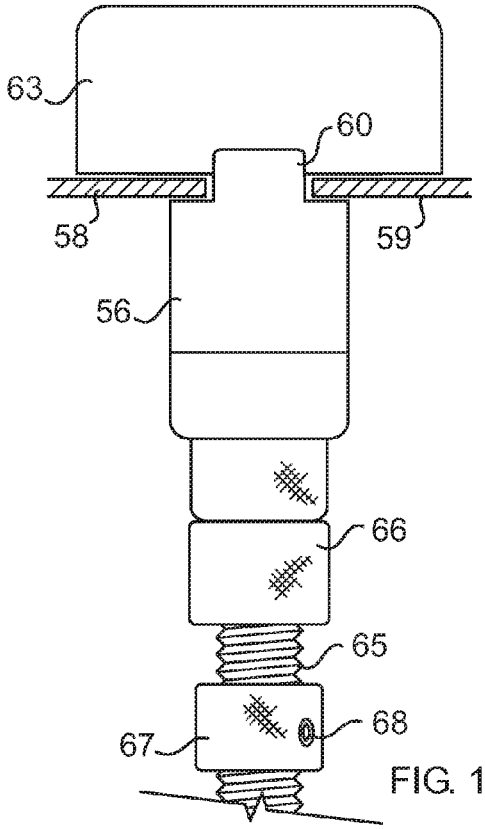
FIG. 14 is a side view of the suspension member located over a pair of flanges.

The rotational movement of the head 63 in reference to the lug 56 is limited or prevented by a squared upper section 69 of the stem proximate to the head. As best illustrated in FIG. 11 and 12, the squared section comprises two pair of diametrically opposed ribs 70*a*, 70*b* and 71*a*, 71*b*, each pair being located angularly orthogonally to the other, and extending in different lengths along the stem. Each of the ribs has two orthogonally convergent sides 72,73 that are tangential to the stem 65. The lug has a transversal cut-out 74 shaped and dimensioned to partially and intimately nest a lower portion of the head when the head and lug are orthogonal to each other as shown in FIG. 14. Due to the different and limited lengths of the rib pairs 70*a*, 70*b*, 71*a*, 71*b* the play of the lug along the stem can be set by the lock nut 67 to allow a 90 degree rotational movement of the head in reference to the lug only when the head and shorter pair of ribs 70*a*, 70*b* is pushed clear of the cutout 73. Accordingly, the device can be accurately manipulated to place the projection 60 of the lug into the slot 57, then rotate the stem and head until it is squarely positioned above the flanges perpendicularly to the slot. The adjustment nut 66 can then be tightened to secure the suspension member 55 to the overhead rail.

It should be understood that the overall shape of the rail, the shape of the lug, and the positions of the ribs and flanges can be modified without affecting the general operation of the disclosed mechanism. For instance, the lug 25 of FIG. 3 may have longitudinal ends of different thicknesses as shown by the dotted line 35 in lieu of a downward projection.

While the preferred embodiments of the invention have been described, modifications can be made and other embodiments may be devised without departing from the spirit of the invention and the scope of the appended claims.

What is claimed is:

1. A device, for releasably suspending a structure at a horizontally adjustable position which comprises:

a rail including:

a pair of sidewalls defining a channel therebetween;

a pair of flanges projecting inwardly from said sidewalls and defining a longitudinal slot therebetween;

a bracket releasably engaged into said channel and including:

a threaded stem of a given diameter;

a head-capping one end of said stem; and a lug having a central, axial bore engaged over said stem; and, wherein:

said slot has a given width greater than said diameter;

said lug having a surface contacting at least one of said flanges; and, said head has an oblong transversal profile of a length greater and a horizontal thickness smaller than said given width;

whereby said head can be longitudinally oriented to pass through said slot, then rotated to come in partial contact with at least one of said flanges and prevent said bracket from escaping said channel.

2. The device of claim 1, wherein said bore is threaded for engagement with said stem;

whereby rotation of said stem brings said said lug against at least one of said flanges.

3. The device of claim 1, wherein said flanges project toward one another in a common plane from distal end portions of said side walls.

4. The device of claim 1, wherein said flanges lie in different planes separated by a given axial distance, and said lug has opposite bearing undersurfaces lying in different planes separated by said given distance.

5. The device of claim 1, wherein said lug further comprises a resiliently compressible layer lining bearing surfaces contacting said flanges.

6. The device of claim 1, wherein said stem has a radial bore in a distal section thereof.

7. The device of claim 1, wherein said bore is dimensioned to allow non-rotational, axial translation of said lug along said stem; and said bracket further includes an adjustment nut dimensioned to screwably engage over said stem and move said lug toward said head;

whereby one of said flanges can be forceably pinched between said head and said lug by rotation of said nut.

8. The device of claim 7, wherein said bracket further comprises a sleeve slidingly engaged over said stem between said lug and said nut.

9. The device of claim 7, wherein:

said rail comprises an horizontal backplate orthogonally secured to upper edges of said sidewalls;

said flanges lie in different planes separated by a given distance;

and said head comprises an extension projecting parallelly to and distally from said stem to a length substantially equal to said distance;

whereby when a flange closest to said backplate is captured between the head and the lug, said extension bears against the other flange.

10. The device of claim 1, wherein:

said head has on oblong transversal profile;

said stem is fixedly secured to said head;

said lug has a cut-out portion spanning said horizontal thickness, and being shaped and dimensioned to partially and intimately nest said head when said head is oriented perpendicularly to said lug.

11. The device of claim 10, wherein:

said stem has a squared upper section proximate said head, said section being shaped and dimensioned to prevent rotation of said head in reference to said lug when said head is not nested into said cut-out portion.

12. The device of claim 11, wherein said lug has a width larger than the width of said slot, and further comprises a longitudinal projection extending upwardly, said projection having a width smaller than the width of said slot.

13. The device of claim 12, wherein said bracket further comprises a lock nut screwably engaged over said stem below said adjustment nut.

14. The device of claim 12, wherein said squared section comprises first and second ribs, each of said ribs having convergent orthogonal sides tangential to said stem.

15. The device of claim 14, wherein one of said ribs extends from said head along said stem to a lesser length than the length of the other of said ribs.

16. The device of claim 14, wherein said ribs are diametrically opposed to each other.

17. The device of claim 1, wherein said head is swivelly secured to said one end of the stein.

18. The device of claim 1, wherein said flanges run continuously within said channel.

19. The combination of a rail and a device for releasably suspending a structure from said rail, wherein:

said rail comprises:

a pair of sidewalls defining a channel therebetween;

a pair of flanges projecting inwardly from said sidewalls and defining a longitudinal slot therebetween; and, said device comprises:

a bracket releasably engaged into said channel and including:

a threaded stem of a given diameter;

a head-capping one end of said stem; and a lug having a central, axial bore engaged over said stem; and, wherein:

said slot has a given width greater than said diameter;

said lug having a surface contacting at least one of said flanges;

said head has an oblong transversal profile of a length greater and a horizontal thickness smaller than said given width;

whereby said head can be longitudinally oriented to pass through said slot, then rotated to come in partial contact with at least one of said flanges and prevent said bracket from escaping said channel.

* * * * *